US010259110B2

(12) United States Patent
Bruggmueller et al.

(10) Patent No.: US 10,259,110 B2
(45) Date of Patent: Apr. 16, 2019

(54) DRIVE-IN TOOL HAVING A PNEUMATIC ACCUMULATOR

(71) Applicant: Hilti Aktiengesellschaft, Schaan (LI)

(72) Inventors: Peter Bruggmueller, Bludesch (AT); Nikolaus Hannoschoeck, Grabs (CH); Christoph Boehm, Gams (CH)

(73) Assignee: HILTI AKTIENGESELLSCHAFT, Schaan (LI)

( * ) Notice: Subject to any disclaimer, the term of this patent is extended or adjusted under 35 U.S.C. 154(b) by 384 days.

(21) Appl. No.: 14/917,652

(22) PCT Filed: Sep. 3, 2014

(86) PCT No.: PCT/EP2014/068693
§ 371 (c)(1),
(2) Date: Mar. 9, 2016

(87) PCT Pub. No.: WO2015/039865
PCT Pub. Date: Mar. 26, 2015

(65) Prior Publication Data

US 2016/0207186 A1 Jul. 21, 2016

(30) Foreign Application Priority Data

Sep. 19, 2013 (EP) ..... 13185168

(51) Int. Cl.
*B25C 1/04* (2006.01)
*B25C 1/06* (2006.01)
*B25C 1/08* (2006.01)

(52) U.S. Cl.
CPC ..... *B25C 1/047* (2013.01); *B25C 1/04* (2013.01); *B25C 1/06* (2013.01); *B25C 1/08* (2013.01)

(58) Field of Classification Search
CPC .. B25C 1/00; B25C 1/04; B25C 1/041; B25C 1/08; B25C 1/008; B25C 1/047; B25C 1/06; B25C 1/14
(Continued)

(56) References Cited

U.S. PATENT DOCUMENTS 4,175,314 A * 11/1979 Spehrley, Jr. ..... B27F 7/19 227/153
4,200,213 A * 4/1980 Liesse ..... B25C 1/08 123/46 SC
(Continued)

FOREIGN PATENT DOCUMENTS

CN 2283552 Y 6/1998
CN 201073758 Y 6/2008
(Continued)

OTHER PUBLICATIONS

Chinese Patent Office, Third Office Action in counterpart Chinese Application No. 201480051913.4, dated Feb. 23, 2018.
(Continued)

*Primary Examiner* — Scott A Smith
(74) *Attorney, Agent, or Firm* — Leydig Voit & Mayer

(57) ABSTRACT

A drive-in tool comprises a hand-held housing having an energy-transmitting element accommodated therein for transmitting energy to a fastener to be driven in; and a drive apparatus for driving the energy-transmitting element; wherein the drive apparatus comprises an energy accumulator having a gas chamber, which gas chamber can be filled with a driving gas at a defined overpressure, wherein the overpressure in the gas chamber is present as stored driving energy before a drive-in process is triggered, and wherein a piston of the energy-transmitting element forms a variable wall segment of the gas chamber, wherein the gas chamber has at least one further variable wall segment for changing the chamber volume, wherein a movement of the variable
(Continued)

wall segment that enlarges the chamber volume charges a mechanical energy accumulator.

20 Claims, 2 Drawing Sheets

(58) Field of Classification Search
USPC ..... 227/9, 10, 130, 129; 123/46 R, 46 SC, 123/46 H; 173/169, 208, 201, 212
See application file for complete search history.

(56) References Cited

U.S. PATENT DOCUMENTS 4,712,379 A * 12/1987 Adams ..... F02B 71/00 60/632
4,773,581 A * 9/1988 Ohtsu ..... B25C 1/08 123/46 SC
5,213,247 A * 5/1993 Gschwend ..... B25C 1/08 227/10
6,123,241 A * 9/2000 Walter ..... B25C 1/08 123/46 SC
6,425,354 B1 * 7/2002 Buchel ..... B25C 1/08 123/46 R
6,666,366 B2 * 12/2003 Rosenbaum ..... B25C 1/08 227/10
6,722,548 B2 * 4/2004 Odoni ..... B25C 1/08 227/10
6,805,272 B1 10/2004 Sen-Mu et al.
6,863,045 B2 * 3/2005 Ricordi ..... B25C 1/08 123/262
6,966,478 B2 * 11/2005 Adams ..... B25C 1/08 123/46 SC
6,971,568 B2 * 12/2005 Schiestl ..... B25C 1/08 227/10
7,004,366 B2 * 2/2006 Schiestl ..... B25C 1/08 123/46 SC
7,178,487 B2 * 2/2007 Zahner ..... B25C 1/08 123/46 H
7,188,590 B2 3/2007 Schiestl et al.
7,246,576 B2 * 7/2007 Schiestl ..... B25C 1/08 123/46 H
7,275,673 B2 * 10/2007 Zahner ..... B25C 1/08 227/10
7,284,511 B2 * 10/2007 Zahner ..... B25C 1/08 123/46 H
7,798,383 B2 * 9/2010 Liesse ..... B25C 1/08 123/46 SC
7,980,440 B2 * 7/2011 Hahn ..... B25C 1/08 123/46 SC
8,205,582 B2 * 6/2012 Adams ..... B25C 1/08 123/46 R
8,267,298 B2 * 9/2012 Zahner ..... B25C 1/08 227/10
8,499,991 B2 * 8/2013 Spasov ..... B25C 1/003 227/131
8,561,869 B2 10/2013 Towfighi
2001/0006044 A1 7/2001 Hasler et al.
2007/0045377 A1 * 3/2007 Towfighi ..... B25C 1/04 227/130
2007/0131731 A1 * 6/2007 Moeller ..... B25C 1/08 227/10

FOREIGN PATENT DOCUMENTS

DE 10 2004 049474 B3 3/2006
DE 10 2005 000107 A1 10/2007
DE 10 2007 000219 A1 10/2008

OTHER PUBLICATIONS

Chinese Patent Office, Search Report in counterpart Chinese Application No. 201480051913.4, dated Sep. 27, 2016.
International Search Report in International Application No. PCT/EP2014/068693, dated Dec. 5, 2014.

* cited by examiner

DRIVE-IN TOOL HAVING A PNEUMATIC ACCUMULATOR

CROSS-REFERENCE TO RELATED APPLICATIONS

The application is the U.S. National Stage of International Application Number PCT/EP2014/068693, filed on Sep. 3, 2014, which claims the benefit of European Patent Application Number 13185168.5, filed on Sep. 19, 2013, which are each incorporated by reference.

The invention concerns a fastener driving tool.

BACKGROUND OF THE INVENTION

Fastener driving tools with various drive means are known from the prior art, including tools operated with external compressed air, tools operated with a combustible gas, or tools that have a mechanical spring energy accumulator.

DE 10 2005 000 107 A1, in the embodiment example shown in FIG. 1, describes a handheld fastener driving tool, in which a piston of a driving ram is accelerated with a force by compressed air of an accumulator compartment. After release of the driving ram, it is accelerated through expansion of the compressed air. The accumulator compartment is recharged by means of an electrically driven compressor.

It is the problem of the invention to specify a fastener driving tool that exhibits good acceleration of an energy transmission element for a given tool size.

BRIEF SUMMARY OF THE INVENTION

For an above-mentioned fastener driving tool, this problem is solved in accordance with the claimed invention. Through the provision of a variable wall segment in combination with a mechanical energy accumulator, a more uniform accelerating force can be exerted on the energy transmission element. Besides the energy elastically stored in the gas, the energy of an additional energy accumulator is utilized for this, where the energy supplied from the additional energy accumulator likewise acts on the piston via the gas pressure in the gas compartment.

A mechanical energy accumulator in the sense of the invention is understood to be any structural element that can accept mechanical energy and intermediately store it. For example, it can be a gas spring or, preferably, an elastically deformable solid body. An elastically deformable solid body is understood to be, among others, coil springs, helical springs, plate springs, torsion bar springs, elastic bands made of an elastomer, or the like.

A fastening element in the meaning of the invention is understood to be any drivable nail, bolt, or even a screw.

In preferred embodiments, the fastener propellant gas is air, in particular ambient air. However, it can also be gases like air, nitrogen, or carbon dioxide from a pressurized reservoir, or also reaction gases from combustion.

In a generally preferred embodiment of the invention, the energy accumulator is an elastically deformable solid body. Such energy accumulators generate lower heat losses and with regard to their spring constant, can readily be combined with the gas compartment.

In a first preferred embodiment of the invention, the energy accumulator comprises an elastic membrane, where the membrane forms the additional wall segment. Through an expansion of the gas compartment volume, the membrane becomes stretched against its elastic restoring force and thus is used as an energy accumulator. In a fastener driving operation, the membrane initially contracts and, at least in a first segment of the motion of the piston, causes the gas pressure acting on the piston to even out.

It is provided in the case of an alternative or even supplemental embodiment that the energy accumulator comprises a piston as additional wall segment and a spring, where the piston is braced against the spring. In this case the advantages of mechanical springs, in particular metal springs, with regard to their low space requirement and the high potential spring constants can be utilized.

In a preferred further development, the piston can be moved in the same direction of motion as the piston of the energy transmission element. This allows a particularly simple design of the remaining housing wall of the gas compartment, for example as a simple or stepped cylinder.

Generally advantageously, the propellant gas is transported into the gas compartment by means of a compressor, which is preferably integrated in the housing. This allows independence from external gas sources such as a compressed air line. Preferably, the compressor in this case comprises an electric motor, where especially preferably the electric motor is powered at least optionally by a battery as its energy source. This enables a cordless tool, and at the same time the high energy densities of modern batteries can be utilized.

Other features and advantages of the invention follow from the embodiment examples and the dependent claims. Below a number of preferred embodiment examples of the invention are described and explained in more detail by means of the appended drawings.

BRIEF DESCRIPTION OF THE SEVERAL VIEWS OF THE DRAWING(S)

DETAILED DESCRIPTION OF THE INVENTION

Figure 1:
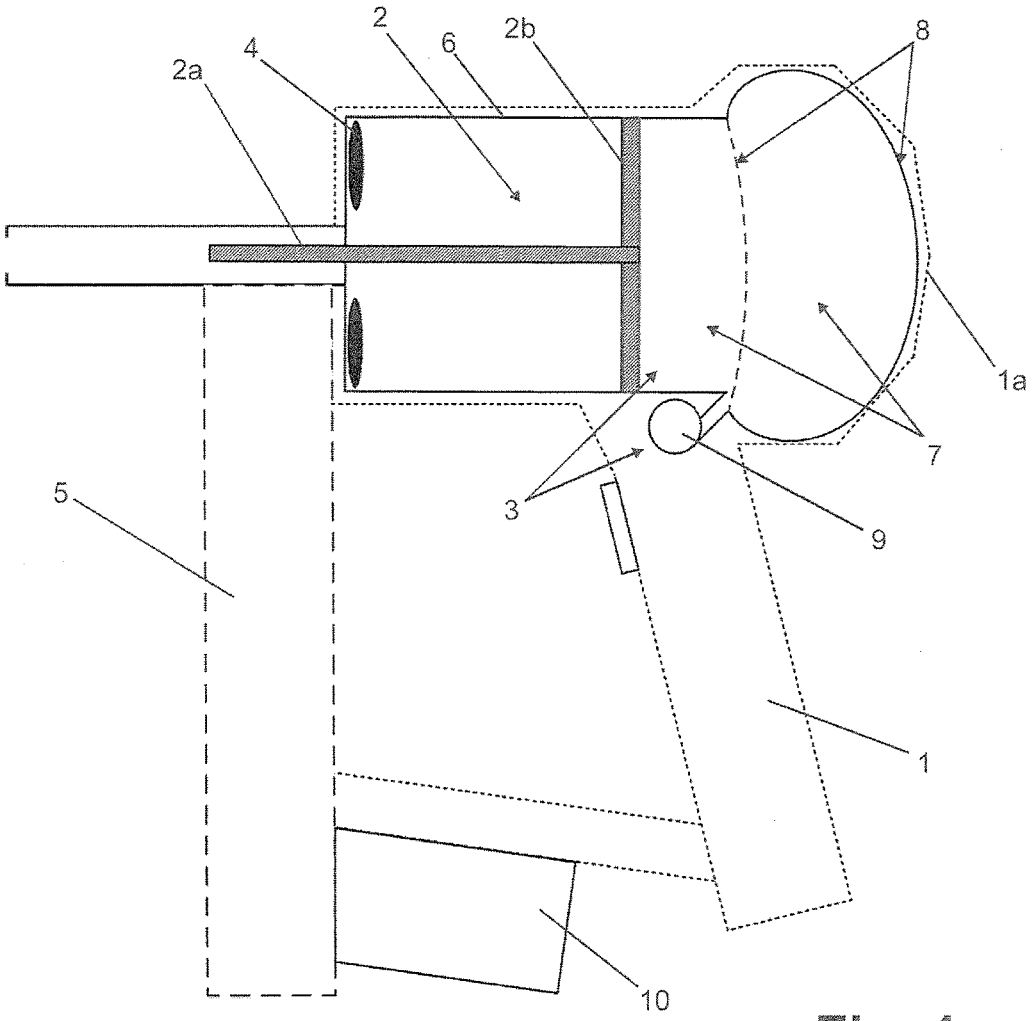
FIG. 1 shows a schematic sectional view of a fastener driving tool according to a first embodiment of the invention.

The fastener driving tool from FIG. 1 according to the invention comprises a handheld housing 1, in which an energy transmission element 2 with a driving device 3 is accommodated. The driving device comprises in this case a gas compartment 7, which can be filled with a propellant gas at specific pressure by means of a compressor 9.

The energy transmission element 2 comprises a driving element 2*a*, in the form of an essentially cylindrical ram. A cushioning stop 4 for the energy transmission element 2 is disposed in a front region of the fastener driving tool.

Fasteners are held in a magazine 5. A fastening element is transported each time by a feed mechanism (not shown) into a compartment, from which it is accelerated by the effect of the driving element 2*a* and is driven into a workpiece (not shown) through a mouthpiece.

The driving element 2*a* is connected to a piston 2*b* of the energy transmission element 2, and the piston 2*b* is guided in a cylinder 6.

The gas compartment 7 can be filled with a propellant gas, in this case compressed air, at an excess pressure with respect to the ambient pressure. The gas compartment 7 is surrounded by a solid wall segment, which also comprises a pressure-side part of cylinder 6, the movable piston 2*b* as a first variable wall segment, and an elastic membrane 8 as a second variable wall segment.

The elastic membrane 8 expands, according to the pressure or degree of filling of the gas compartment 7 against its inherent material stress. Through this, it forms a mechanical energy accumulator, in which energy is stored in addition to the energy in the gas, which is under pressure. To avoid overstretching of the membrane, it is surrounded by a solid housing wall 1*a*, against which it can lie at the maximum expansion.

Filling of the gas compartment 7 takes place by means of compressor 9, which is only shown schematically in the figures. The compressor 9 is driven by an electric motor, for example a spinning electric motor in combination with an oscillating mechanism. The energy source of the electric motor is a battery 10 provided on the housing 1.

For examples of detail and design of the compressor and its drive and also other components of the fastener driving tool such as a trigger device and a return spring for the energy transmission element, one is referred in particular to DE 10 2005 000 107 A1.

The invention now operates as follows:

In the indicated starting position of piston 2*b*, ambient air is pumped into the gas compartment 7 by means of the compressor until a specific pressure is reached. This can in particular be a maximum pressure of the compressor.

As this happens, the membrane 8 is converted from a relaxed state (dashed line in FIG. 1) to a stretched and tensioned state (continuous line in FIG. 1).

In this state the tool can be triggered when needed, which takes place through an electromechanical release of the energy transmission element 2, which was previously locked in place. After its release, the piston 2*b* is accelerated in the forward direction by the applied pressure. Since the membrane relaxes at first, the gas pressure is only reduced a little in at least a first segment of motion.

Figure 2:
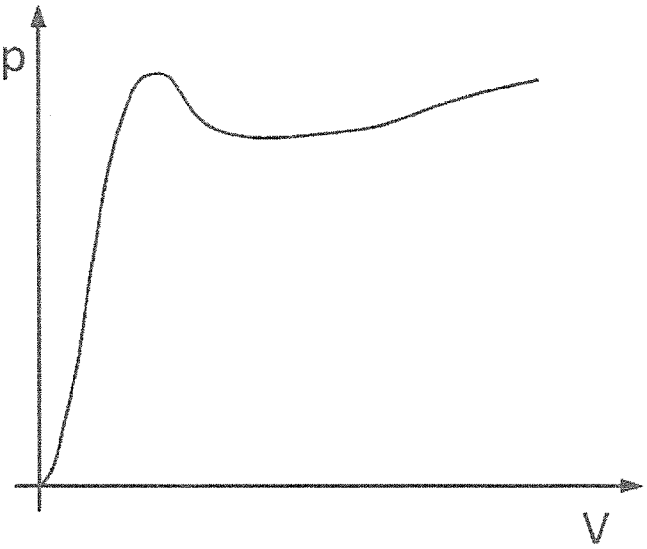
FIG. 2 shows a pressure/volume graph of the device from FIG. 1.

FIG. 2 shows a graph of the relationship between the pressure and volume in the gas compartment 7. Through the effect of the elastic membrane, there is good constancy of the gas pressure as long as the membrane is in an at least partially tensioned state.

After driving in the fastener, the energy transmission element 2 is reset to the starting position by a return spring (not shown) and locked in place. This is followed by refilling of the gas compartment 7 by the compressor 9.

Figure 3:
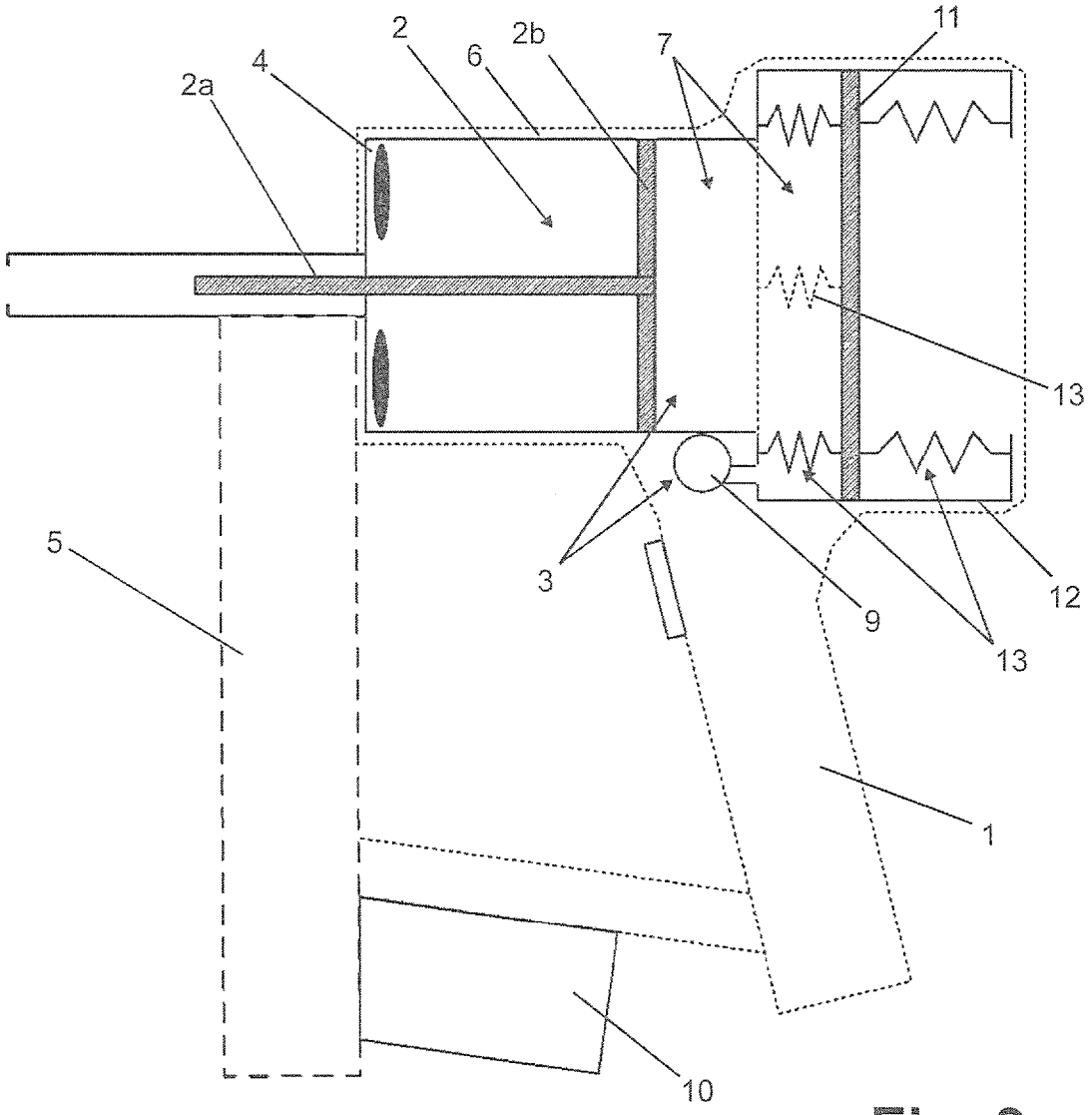
FIG. 3 shows a schematic sectional view of a fastener driving tool according to a second embodiment of the invention.

In the second embodiment example of the invention shown in FIG. 3, an additional piston 11 is provided instead of the elastic membrane 8, the piston being guided movably in a rear segment of the gas compartment 7, which is formed as a cylinder 12, and in this way forms a variable wall segment of the gas compartment 7, in addition to piston 2*b*.

Piston 11 is guided gastight along cylinder 12, where cylinder 12 is freely connected to the atmosphere on the outer side of piston 11. Piston 11 is additionally braced against a plurality of springs 13, which in this case are coil springs made of metal. In embodiment examples that are not shown, they are torsion bar springs, helical springs, or leaf springs of metal or plastic or an elastomer. A plurality of springs 13 is shown schematically, each of which acts as tension spring or pressure spring according to its position with respect to the piston. The springs 13 can be disposed inside and/or outside the gas compartment 7. Space in the tool can be saved with particular efficiency by an at least partial arrangement inside the gas compartment.

The function of the fastener driving tool according to the second embodiment example is analogous to the first embodiment example, with the difference that the springs form the additional mechanical energy accumulator instead of the membrane material. In this case the piston 11 moves against the force of springs 13 when the pressure in the gas compartment arises, so that the gas compartment becomes larger, as in the first embodiment example.

Of course, the individual features of the different embodiment examples can be combined with each other in each case according to requirements.

The invention claimed is:

1. A fastener driving tool for driving a fastening element, the fastener driving tool comprising a handheld housing having accommodated therein, an energy transmission element for transmitting energy to the fastening element, the energy transmission element comprising a piston; and a driving device for driving the energy transmission element, the driving device comprising an energy accumulator with a gas compartment, the gas compartment having variable wall segments and a gas compartment volume, which can be filled with a propellant gas at a specific excess pressure, such that the excess pressure in the gas compartment is present as stored driving energy before triggering operation of the fastener driving tool to drive the fastening element, and wherein the piston of the energy transmission element forms a variable wall segment of the gas compartment, and the gas compartment has at least one additional variable wall segment for changing the gas compartment volume, wherein movement of the at least one additional variable wall segment that enlarges the gas compartment volume charges the energy accumulator.

2. The fastener driving tool as in claim 1, wherein the energy accumulator comprises an elastically deformable solid body.

3. The fastener driving tool as in claim 2, wherein the energy accumulator comprises an elastic membrane that forms the additional variable wall segment.

4. The fastener driving tool as in claim 3, wherein the propellant gas is transported into the gas compartment by a compressor.

5. The fastener driving tool as in claim 4, wherein the compressor comprises an electric motor.

6. The fastener driving tool as in claim 5, wherein the electric motor is driven by a battery as energy source.

7. The fastener driving tool as in claim 2, wherein the energy accumulator comprises a piston and a spring, wherein the piston forms the additional variable wall segment and is braced against the spring.

8. The fastener driving tool as in claim 7, wherein the piston can be moved in a same direction of motion as the piston of the energy transmission element.

9. The fastener driving tool as in claim 8, wherein the propellant gas is transported into the gas compartment by a compressor.

10. The fastener driving tool as in claim 9, wherein the compressor comprises an electric motor.

11. The fastener driving tool as in claim 7, wherein the propellant gas is transported into the gas compartment by a compressor.

12. The fastener driving tool as in claim 11, wherein the compressor comprises an electric motor.

13. The fastener driving tool as in claim 12, wherein the electric motor is driven by a battery as energy source.

14. The fastener driving tool as in claim 2, wherein the propellant gas is transported into the gas compartment by a compressor.

15. The fastener driving tool as in claim 14, wherein the compressor comprises an electric motor.

16. The fastener driving tool as in claim 15, wherein the electric motor is driven by a battery as energy source.

17. The fastener driving tool as in claim 1, wherein the propellant gas is transported into the gas compartment by a compressor.

18. The fastener driving tool as in claim 17, wherein the compressor comprises an electric motor.

19. The fastener driving tool as in claim 18, wherein the electric motor is driven by a battery as energy source.

20. The fastener driving tool of claim 17, wherein the compressor is integrated in the handheld housing.

* * * * *